US009289809B2

(12) United States Patent
Cramer et al.

(10) Patent No.: US 9,289,809 B2
(45) Date of Patent: Mar. 22, 2016

(54) DEVICE AND METHOD FOR HANDLING A METAL STRIP

(75) Inventors: Ulrich Cramer, Attendorn (DE); Thomas Holzhauer, Kirchhundem (DE); Wolfgang Fuchs, Hilchenbach (DE); Andreas Kastner, Kirchhundem (DE); Christian Mengel, Siegen (DE); Heinz-Adolf Mueller, Wilnsdorf (DE); Carsten Heide, Netphen (DE); Karl Robert Hofmann, Netphen (DE)

(73) Assignee: SMS GROUP GMBH, Duesseldorf (DE)

( * ) Notice: Subject to any disclaimer, the term of this patent is extended or adjusted under 35 U.S.C. 154(b) by 305 days.

(21) Appl. No.: 13/992,312

(22) PCT Filed: Nov. 8, 2011

(86) PCT No.: PCT/EP2011/069612

§ 371 (c)(1),
(2), (4) Date: Jun. 7, 2013

(87) PCT Pub. No.: WO2012/076273

PCT Pub. Date: Jun. 14, 2012

(65) Prior Publication Data

US 2013/0256439 A1 Oct. 3, 2013

(30) Foreign Application Priority Data

Dec. 10, 2010 (DE) ..... 10 2010 062 865
Aug. 4, 2011 (DE) ..... 10 2011 080 410

(51) Int. Cl.
*B21C 47/24* (2006.01)
*B21C 47/28* (2006.01)

(Continued)

(52) U.S. Cl.
CPC ..... *B21C 47/24* (2013.01); *B21C 47/28* (2013.01); *B21C 47/326* (2013.01); *B65B 27/06* (2013.01)

(58) Field of Classification Search
CPC ..... B65B 11/04; B65B 25/24; B65B 27/06; B21C 47/22; B21C 47/24; B21C 47/326; B65H 19/126; B65H 2301/4172; B65H 2301/4173; B65H 2301/41734; B65H 2301/3175; B65H 2405/422; Y10S 414/124
USPC ..... 100/2, 3, 12, 13; 242/363; 53/204, 409, 53/588
See application file for complete search history.

(56) References Cited

U.S. PATENT DOCUMENTS 2,816,792 A * 12/1957 Dixon ..... B66C 1/24 294/103.2
3,300,158 A * 1/1967 Strong ..... B21C 47/146 242/361.3

(Continued)

FOREIGN PATENT DOCUMENTS

DE 1940426 3/1970
DE 2806245 8/1979

(Continued)

*Primary Examiner* — Jimmy T Nguyen
(74) *Attorney, Agent, or Firm* — Abelman, Frayne & Schwab

(57) ABSTRACT

The invention relates to a device and a method for handling a metal strip. The device comprises a coiling device (110) with a coiling mandrel (112) for winding the metal strip to form a coil (200) on the coiling mandrel and a coil stripper car (120) with supports (124) for receiving the coil (200) from the coiling mandrel and removing the coil from the coiling device (110). In order to additionally secure the metal strip in the coiling device during the transfer from the coiling mandrel onto the coil stripper care and during a transport by means of the coil stripper car, a first hold-down arm (130) is provided for exerting a first hold-down force (F1) onto the outer circumference of the coil (200) in order to press the coil onto the supports of the coil stripper car.

14 Claims, 6 Drawing Sheets

(51) Int. Cl.
*B65B 27/06* (2006.01)
*B21C 47/32* (2006.01)

(56) References Cited

U.S. PATENT DOCUMENTS

| | | | | | |
|---|---|---|---|---|---|
| 3,633,492 | A * | 1/1972 | Gilvar | B65B 27/06 | 100/12 |
| 3,921,510 | A * | 11/1975 | Glasson | B65B 27/06 | 100/12 |
| 4,854,806 | A | 8/1989 | Gertsch | | |
| 5,044,862 | A | 9/1991 | Herigstad | | |
| 6,341,476 | B2 * | 1/2002 | Golightly | 100/12 | |
| 7,314,196 | B2 | 1/2008 | Gandelheidt | | |
| 8,096,158 | B2 | 1/2012 | Moser | | |
| 2010/0294874 | A1 | 11/2010 | Niehues | | |

FOREIGN PATENT DOCUMENTS

| | | |
|---|---|---|
| DE | 2901454 | 7/1980 |
| DE | 4334582 | 4/1995 |
| DE | 19714551 | 10/1998 |
| DE | 102007017383 | 8/2008 |
| EP | 1647508 | 4/2006 |
| JP | 03-193215 | 8/1991 |
| JP | 06-047438 | 2/1994 |
| JP | 07-025525 | 1/1995 |
| JP | 07-265950 | 10/1995 |
| JP | 2007-044747 | 2/2007 |
| JP | 2011-020761 | 3/2011 |
| SU | 479511 | 8/1975 |

* cited by examiner

DEVICE AND METHOD FOR HANDLING A METAL STRIP

RELATED APPLICATIONS

This application is a National Stage application of International application PCT/EP2011/069612 filed Nov. 8, 2011 and claiming priority of German applications DE 10 2010 062 865.4 filed Dec. 10, 2010 and DE 10 2011 080 440.2 filed Aug. 4, 2011.

BACKGROUND OF THE INVENTION

1. Field of the Invention

The invention relates to a method and to a device for handling a metal strip. The device comprises in particular a coiling device for winding the metal strip to form a coil and a coil stripper car for receiving the coil from the coiling device.

2. Description of the Prior Art

Numerous documents are known in the prior art that deal in general with the topic of handling wound metal strips.

Thus, the unexamined German Patent Application DE 10 2007 051 976 A1 discloses a coiling device and a method for securing the coils in the coiling device. In concrete terms, the unexamined patent application discloses a coiling device for winding the hot rolled strip after the rolling to form a coil. Moreover, a device is disclosed for producing a welded connection, in order to weld the end of the metal strip on the outer circumference of the coil to a winding that is located farther inward. In this manner, the coil is secured and prevented from violently uncoiling.

In the patent application DE 10 2009 060 257.7, which has not been prepublished, a support for a metal coil on a coiling device is proposed, wherein the coil, referred to also as a coil in the English language, is deposited on three support points. A hold-down device for pressing the coil onto the support points is not disclosed; this has the disadvantage that high-strength metal strips that have a strong tendency to uncoil violently cannot be stored absolutely securely on three support points.

The unexamined German Patent Application DE 10 2007 017 383 A1 discloses a device for binding a coil, which is located on a mandrel set in rotation by a driving unit. In order to be able to achieve a secure and reliable hold, even in the case of a coil that has been coiled from thick strips and has a strong tendency to uncoil violently, the document discloses that at least one pressing roller is provided, by means of which the previously bent flat steel strip is guided around the coil, in order to secure the coil against violent uncoiling.

More remote from the subject matter of the invention are the following additional documents, for example: JP 6047438 A, DE 29 01 454, DE 102004029067 A1, EP 1 647 508 A1, DE 19714551 A1, DE 1940426 A, U.S. Pat. No. 5,044,862 A, DE 3 609 086 A1, DE 43 34 582 A1 and DE 2 806 245 A1.

The European Patent EP 1 888 284 B1 discloses a device and a method for removing a sample from a metal strip that has been wound to form a coil. The device according to the invention provides two floor rollers for storing a coil. At least one of the floor rollers is designed so it can be driven by a driving unit. The strip end has to be fixed, particularly in the case of higher strength strips but also in the case of thicker strips, permanently by one of the rollers, in order to prevent undesired violent uncoiling of the coil. Besides the two floor rollers, at least one pressing roller is provided, which contacts the coil at its outside surface, and fixes it with regard to its position. One of the two floor rollers is designed so that it can be lowered, and, after the fixation of the coil, it can be swiveled by the remaining bottom roller and the at least one pressing roller away from the coil. Due to the swiveling away of one of the floor rollers, an enlarged free strip length remains between the remaining floor roller and the pressing roller, as a result of which the local deformation of the strip end is reduced, without any associated risk of violent uncoiling of the coil.

The invention is based on the following closest prior art:

In the production of hot-rolled strips, that is hot rolled metal strips, on hot strip coiling devices, the finished coils are transported at the end of the winding process by means of a coil stripper car out of the coiling device. For this purpose, the coil stripper cars move under the coil when the latter has been completely wound in the coiling device on the coiling mandrel. The typically two supports of the coil stripper car are then raised, and placed from below against the coil on the coiling mandrel in such a manner that the coil then is applied against the two supports, after the coiling mandrel has been contracted and/or pulled out of the eye of the coil. The coil stripper car is used here first for securing the end of the metal strip, by twisting the coil in such a manner on the two supports that the strip end is pressed due to the gravity force of the coil against the support. After such a deposition of the coil on the coil stripper car, the coil is moved to a coil binding device by means of the coil stripper car.

In conventional hot strips, the production of metal strips tends to involve particularly high strengths and strip thicknesses. Said metal strips are used for producing pipe steels, as well as for extremely strong surfaces. If these materials are wound, then a residual tension remains in the coil, which will open the end of the metal strip again. This tendency increases with greater strength and greater strip thickness, and it occurs particularly in the case of small coils of low gravity force and small diameter. Typical coil diameters are 1000-2300 mm.

In such special coils with high internal residual tension, the coil gravity force often is insufficient to secure the end of the metal strip or the coil on the two supports of the coil stripper car. Rather, there is a risk that the coil can no longer be pulled reliably off the coiling mandrel and moved to the binding station. The coil can remain suspended on the coiling mandrel, and lift itself from the coil stripper car or violently uncoil.

Based on this prior art, the problem of the invention is to further develop a device and a method for handling a metal strip so that the handling of the metal strip, particularly of a metal strip with high residual tension is additionally secured, at the time of the transfer from the coiling mandrel to the coil stripper car, as well as during a transport with the coil stripper car.

SUMMARY OF THE INVENTION

The invention is characterized by a first hold-down arm for exerting a first hold-down force onto the outer circumference of the coil for pressing the coil against supports of the coil stripper car.

As a result of the claimed provision of the hold-down arm, a force having at least one component in the direction of the gravity force is applied to the outer circumference of the coil, as a result of which the coil is advantageously prevented from violently uncoiling.

In principle, the invention can be used for coils without inner residual tension, with slight residual tension, or with high residual tension. In the case of coils without residual tension or with only slight residual tension, the first hold-down arm can in fact be dispensed with; however, it is not detrimental if said hold-down arm according to the invention is nonetheless provided even in these cases. The hold-down arm can be designed to exert an active pressing force onto the outer circumference of the coil. Alternatively, the hold-down arm can also be applied without force but at a fixed height against the outer circumference of the coil. In the case of a placement without force, the active pressing force, which is the same as the hold-down force, is exceptionally equal to zero. A (counter) force can be produced in this case, when the coil attempts to uncoil violently, but the first hold-down arm positioned such that its height is fixed prevents the violent uncoiling.

DEFINITIONS

Coil refers to a coil or a wound coil made of a flat metal strip, particularly a hot-rolled metal strip, or of a nonflat material, for example, wire. The coil is typically made of metal, for example, of steel.

The term "handling a metal strip" in the sense of the present invention denotes in particular the transfer of a coil from a coiling mandrel to a coil stripper car and to the transport of the coil on the coil stripper car.

The supports of the coil stripper car can be designed in such a manner that a point-shaped, line-shaped or flat contact with the deposited coil is produced.

According to a first embodiment example, the device for handling a metal strip comprises an overhang beam which is arranged over a path for the coil stripper car, a trolley for holding the hold-down arm and for moving the hold-down arm on the overhang beam, and a synchronization device for synchronizing the movement of the trolley with the hold-down arm and of the coil stripper car in such a manner that the first hold-down arm is applied advantageously during the movement of the coil stripper car continuously against the outer circumference of the coil. In this manner, advantageously, a continuous securing of the coil during the transport on the coil stripper car is ensured.

The synchronization device can be designed in the form of an electric control or in the form of a mechanical coupling of the coil-side end of the hold-down arm on the coil. The overhang beam is anchored, for example, at least one end in a fixed position on or in the area of the coiling device.

Alternatively to moving the first hold-down arm with a trolley along the overhang beam, the first hold-down arm can also be coupled mechanically at its end away from the coil circumference to the coil stripper car.

In addition to the first hold-down arm, the device advantageously comprises a second hold-down arm for exerting a second pressing force F2, which is the same as a second hold-down force, with its coil-side end in the eye of the coil so that the coil is pressed onto the coil stripper car.

The second hold-down arm can be attached to the coil stripper car or an additional coil car. The additional coil car is then designed preferably so that it can be shifted synchronously with the coil stripper car which carries the coil.

The first and/or second hold-down arm is/are preferably designed with adjustable height. The first and/or second hold-down arm can be designed so that it can be moved in or out telescopically.

The first hold-down arm is preferably designed so as to be placed on the circumference of the coil in such a manner that the first hold-down force F1 applied to the coil has at least one component in the direction of the gravity force. The second hold-down arm is preferably designed so that it is placed in the eye of the coil in such a manner that the second hold-down force F2 exerted by same has at least one component in the direction of the gravity force.

The above-mentioned problem is solved moreover by a method for handling the metal strip. The advantages of this method correspond in principle to the advantages mentioned above in reference to the claimed device.

In a particularly advantageous embodiment, the method according to the invention provides that, during the removal of the coil from the coiling device, the first hold-down arm acts on the outer circumference of the coil, wherein the first hold-down arm is moved synchronously with the coil and the coil stripper car.

However, the range of the first hold-down arm is limited if it is moved by means of a trolley along an overhang beam arranged on the coiling device. In order to ensure, even during the further transport of the coil, a secure stowing of the coil on the coil stripper car, beyond the range of the first hold-down arm, the method according to the invention provides that, using the second hold-down arm, a second hold-down force is applied in the eye of the coil, in order to press the coil against the support of the coil stripper car. Then the second hold-down arm can, however, protrude into the eye of the coils, after the coil has been moved at least some distance out of the coiling device and pulled off the coiling mandrel by means of the coil stripper car.

After the second hold-down arm engages in the eye of the coil, the first hold-down arm can be removed from the outer circumference of the coil, because its function of pressing the coil against the support is then taken over by the second hold-down arm.

Since the second hold-down arm takes over the function of the first hold-down arm and thus secures the coil on the coil stripper car, the coil on the coil stripper car can also be transported beyond the range of the first hold-down arm, for example, toward a coil binding machine.

When the second hold-down arm by means of its end away from the coil is anchored or attached on an additional coil car, it is necessary to ensure that the additional coil car moves synchronously with the coil stripper car, in order to maintain the second hold-down force F2 continuously in the eye of the coil during a further transport of the coil.

After securing the coil by welding its strip end or by binding in a coil binding machine, the second hold-down arm can also be removed from the eye of the coil.

As already indicated above, the device according to the invention and the method according to the invention are preferably suitable for handling coils with high residual tension, which tend to uncoil violently. However, the invention is not limited to such coils, but can in principle also be used with coils without risk of violent uncoiling. With a view to a preferred use, the method according to the invention provides that, before the use of the method, a verification is first carried out to determine whether there is a risk of violent uncoiling of the coil to be handled owing to a higher internal residual tension. It is preferable that the method according to the invention for handling the coil be provided only if the risk of violent uncoiling of the coil established beforehand exceeds a predetermined threshold value. The risk of violent uncoiling can be evaluated physically depending on the strength of the material strip, the strip thickness, and the gravity force or the diameter of the coil to be handled. In concrete terms, the mentioned physical parameters can each be compared with a predetermined threshold value, and the risk of violent uncoiling of the coil can then be defined as existing if at least some thresholds are exceeded.

In concrete terms, the risk of violent uncoiling can be established if the threshold values for the thickness and strength of the metal strip have been exceeded, and at the same time the threshold value for the diameter of the coil has not been reached.

Additional advantageous embodiments of the device according to the invention and of the method according to the invention constitute the subject matter of the dependent claims.

BRIEF DESCRIPTION OF THE DRAWINGS

Eight figures are included with the invention, wherein.

DETAILED DESCRIPTION OF THE PREFERRED EMBODIMENT

Figure 1:
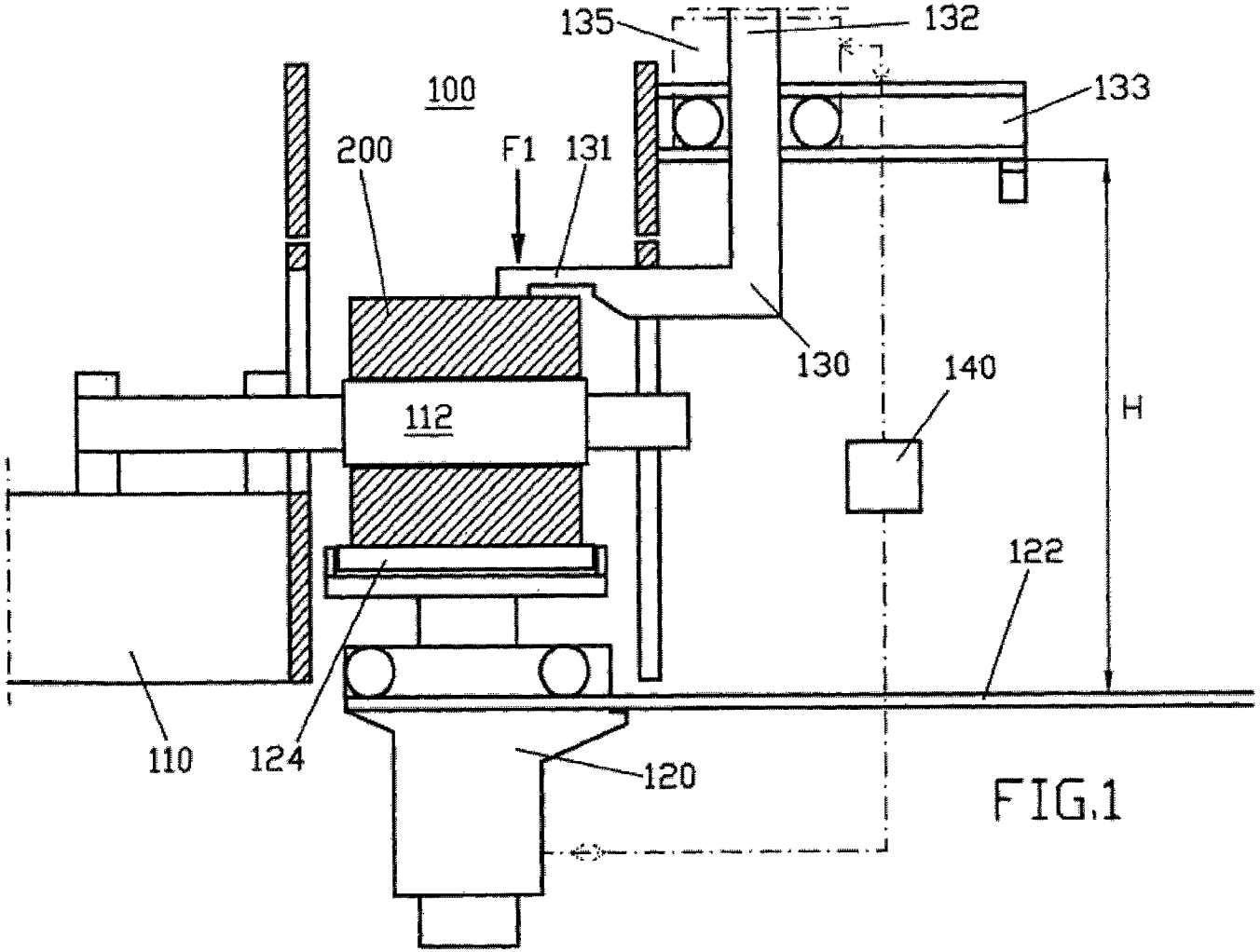
FIG. 1 shows a device according to the invention according to a first embodiment example.

The invention is described in detail below in reference to the mentioned figures in the form of embodiment examples. The same technical elements are marked with the same reference numeral in all the figures.

FIG. 1 shows the device 100 according to the invention according to a first embodiment example. Accordingly, the device 100 for handling a metal strip comprises a coiling device 110 with a coiling mandrel 112 for winding the metal strip to form a coil 200. The coil 200 is shown wound on the coiling mandrel 112 in FIG. 1.

Moreover, the device 100 according to the invention comprises a coil stripper car 120, which, as an example in FIG. 1, is mounted so that it can be moved on a fixed track configuration 122. The coil stripper car 120 comprises, for example, two supports 124 for receiving the coil 200 from the coiling mandrel 112. For this purpose, the supports 124, whose height 124 is adjustable with respect to the track configuration 122, are placed from below vertically against the lower half of the coil 200. In this lifting hedgehog position, the coil 200 is kept at its height by the supports of the coil stripper car. Optionally, in addition to the supports, a swivel arm can also be provided on the coil stripper car, which additionally presses in particular the end of the metal strip from below, that is to say against gravity against the coil, and in this manner it stabilizes the coil additionally on the coil stripper car. The coiling mandrel 112 is then collapsed or contracted, so that it loses the contact with the inner eye of the coil 200. The coil stripper car 120 then pulls the coil 200 in a frozen lifting hedgehog position from the coiling mandrel 112, and removes it from the coiling device.

In order to prevent a violent uncoiling of the coil in the coiling device, particularly in the case of coils having a high residual tension, a first hold-down arm 130 is provided according to the invention, in order to exert a first hold-down force F1 onto the outer circumference of the coil 200. The hold-down arm is used for pressing the coil against the support of the coil stripper car. According to the first embodiment example shown in FIG. 1, the first hold-down arm 130 is connected by means of its end away from the coil 132 to a first trolley 135, and it can be moved using this trolley along an overhang beam 133. The overhang beam 133 is arranged above the track configuration 122, preferably at a constant height H, and it is attached, for example, by means of an end in the area of or on the coiling device 110.

A synchronization device 140 according to the invention, which is preferably designed in the form of an electronic control, is designed to synchronize the movement of the trolley with the first hold-down arm 130 with the movement of the coil car 120 with the coil 200 in such a manner that the first hold-down arm 130, while the coil 200 is being removed from the coiling device 110, is continuously applied against the outer circumference of the coil 200. For this purpose, the trolley 135 with the first hold-down arm 130 has to be moved synchronously with the coil stripper car 120 and the coil 200. If the distance, for example, the height H, between the overhang beam 133 and the track configuration 122 along the course of the overhang beam varies, then the synchronization device 140 has to be designed additionally so as to compensate for these varying distances, for example, by variably adapting the first hold-down arm 130 in terms of its height position with respect to the trolley 135, or by adjusting its height.

Alternatively to a design of the synchronization device in the form of an electronic control, the synchronization device can also be designed in a simplified manner in the form of a mechanical coupling of the coil-side end of the first hold-down arm 130 to the outer circumference of the coil 200. The coil-side end of the first hold-down arm is then guided by the coil itself. The mechanical coupling of the end away from the coil 132 of the first hold-down arm on the trolley then has to be designed in such a manner that the exertion of the first hold-down force F1 onto the coil is still ensured.

Figure 2:
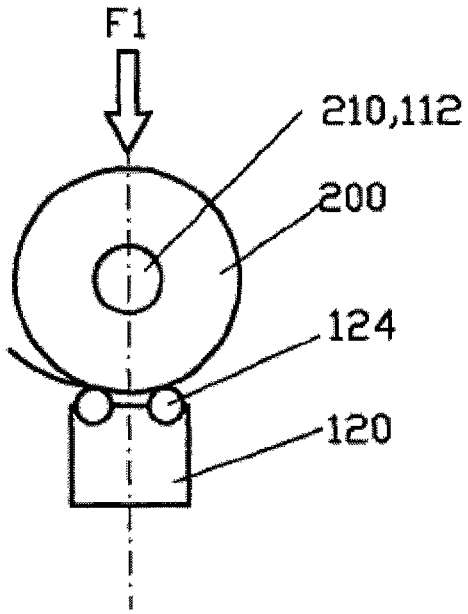
FIG. 2 shows the coil, deposited on the coil stripper car with the action of the first hold-down force.

FIG. 2 shows the coil 200 deposited on the supports 124 of the coil stripper car 120, when the first hold-down force F1 acts on the outer circumference of the coil 200, in accordance with the operating state of the device according to the invention depicted in FIG. 1. The eye of the coil 200, in FIG. 2, is marked with the reference numeral 210. In the operating state shown in FIG. 1, this eye is filled with the coiling mandrel 112.

Figure 3:
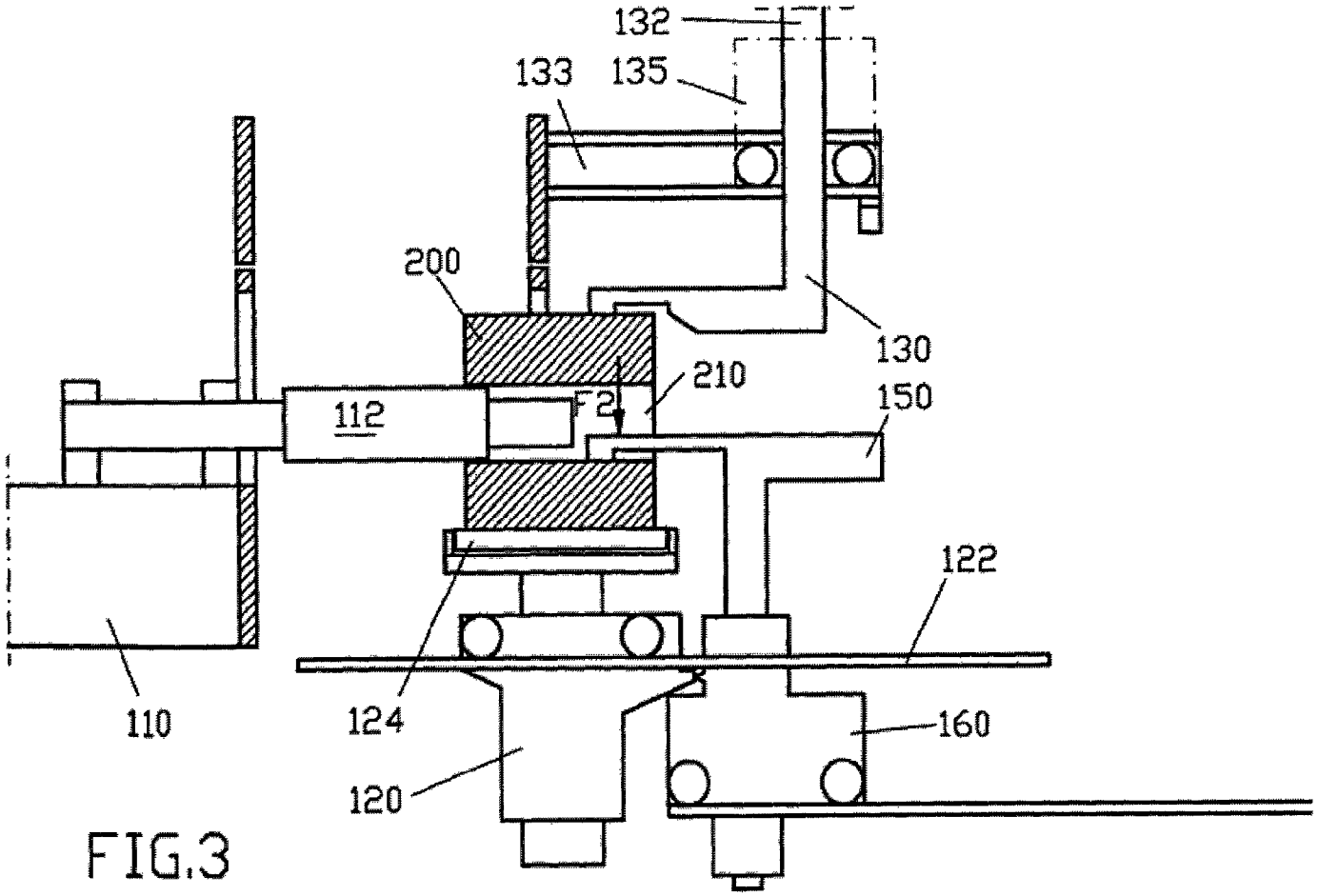
FIG. 3 shows the device according to the invention after the coil has been removed at least partially from the coiling device.

FIG. 3 shows the device according to the invention according to the first embodiment in a second later operating state in comparison to FIG. 1. The coil 200, in the later operating state shown in FIG. 3, is already removed by means of the coil stripper car some distance from the coiling device. The coiling mandrel 112 now already frees a portion of the eye 210 of the coil 200 for the introduction of a second hold-down arm 150. The second hold-down arm, in the first embodiment example depicted in FIG. 3, is mounted on an additional coil car 160. Alternatively, the second hold-down arm 150 can, however, also be mounted on the coil stripper car 120.

It is important that the first hold-down arm 130 always still acts on the outer circumference of the coil 200, in order to secure the coil on the coil stripper car, while the second hold-down arm is introduced into the eye 210.

In FIG. 3, the trolley 135 has reached the end of the overhang beam 133; that is to say, in the operating state depicted in FIG. 3, the end of the range of the first hold-down arm 130 has been reached. For a further transport of the coil, the first hold-down arm 130 is raised from the circumference of the coil 200, after the second hold-down arm 150 in the eye 210 of the coil exerts the second hold-down force F2 to press the coil 200 against the support 124 of the coil stripper car 120. The first and the second hold-down forces F1, F2 are in each case dimensioned larger than the imminent uncoiling force of the coil. The two hold-down forces are equal in amount, for example.

Figure 4:
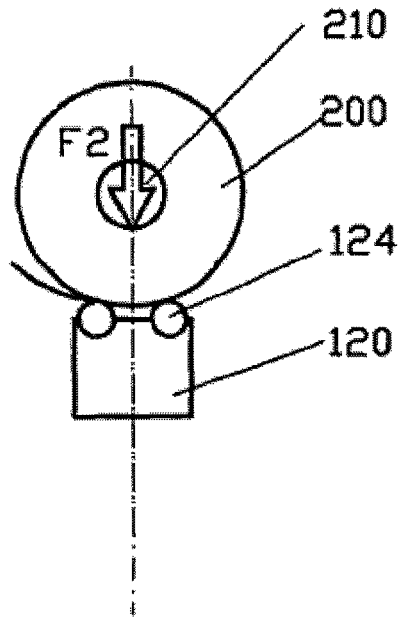
FIG. 4 shows the action of the second hold-down force in the eye of the coil.

FIG. 4 shows in cross section the operating state which has just been described, in which the second hold-down force F2 engages in the eye 210 of the coil 200.

Figure 5:
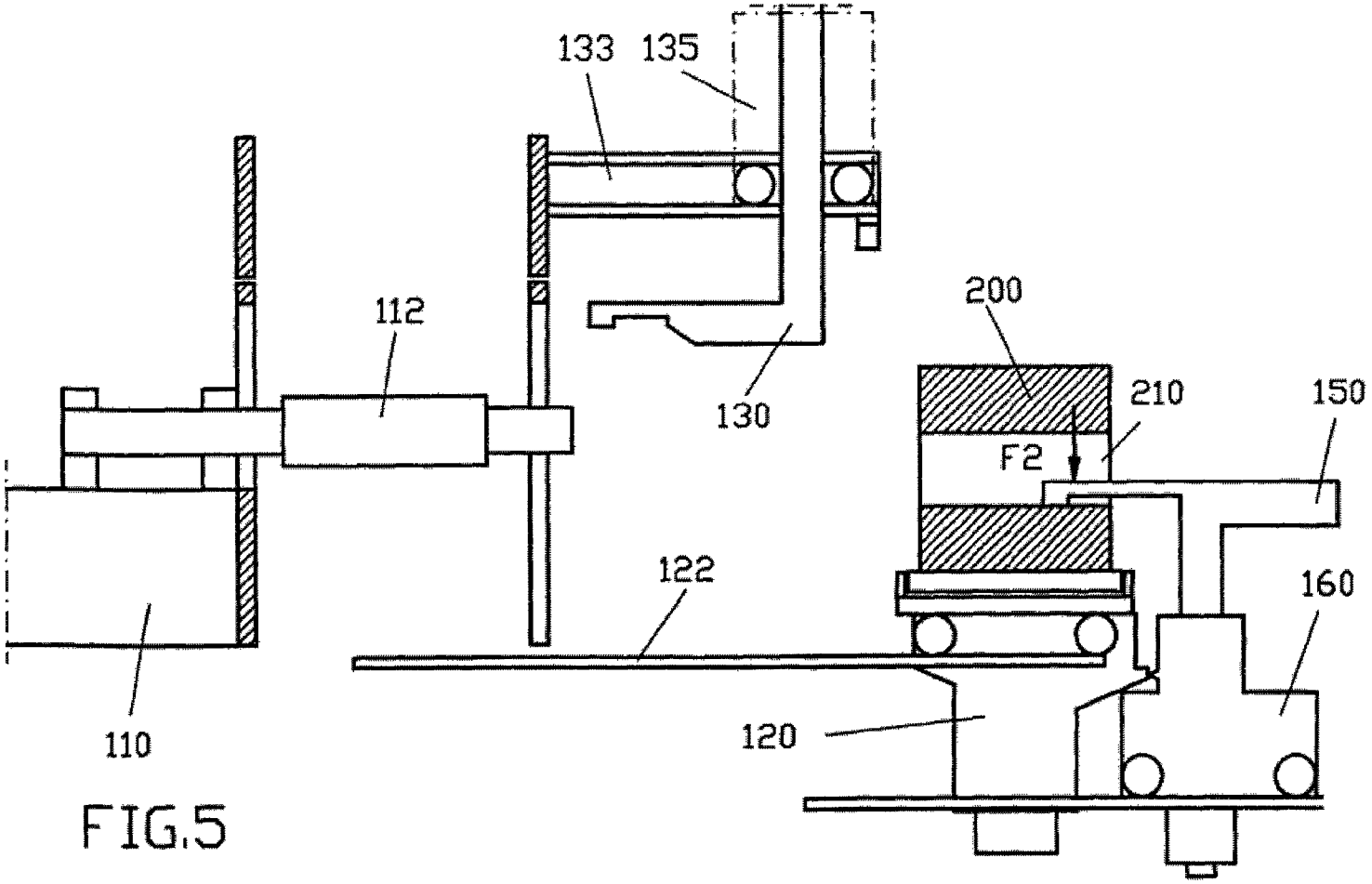
FIG. 5 shows the device according to the invention when the coil has moved beyond the range of the first hold-down arm.

FIG. 5 shows the device according to the invention according to the first embodiment example in a third operating state, in which the coil has been moved beyond the range of the coiling device 110 and of the first hold-down arm 130 by means of the coil stripper car. The additional coil car 160 has been moved synchronously with the coil stripper car 120, in order to maintain the second hold-down force F2 in the eye 210 of the coil 200, by means of the second hold-down arm 150, during the further transport of the coil, for example, toward a binding device.

Figure 6:
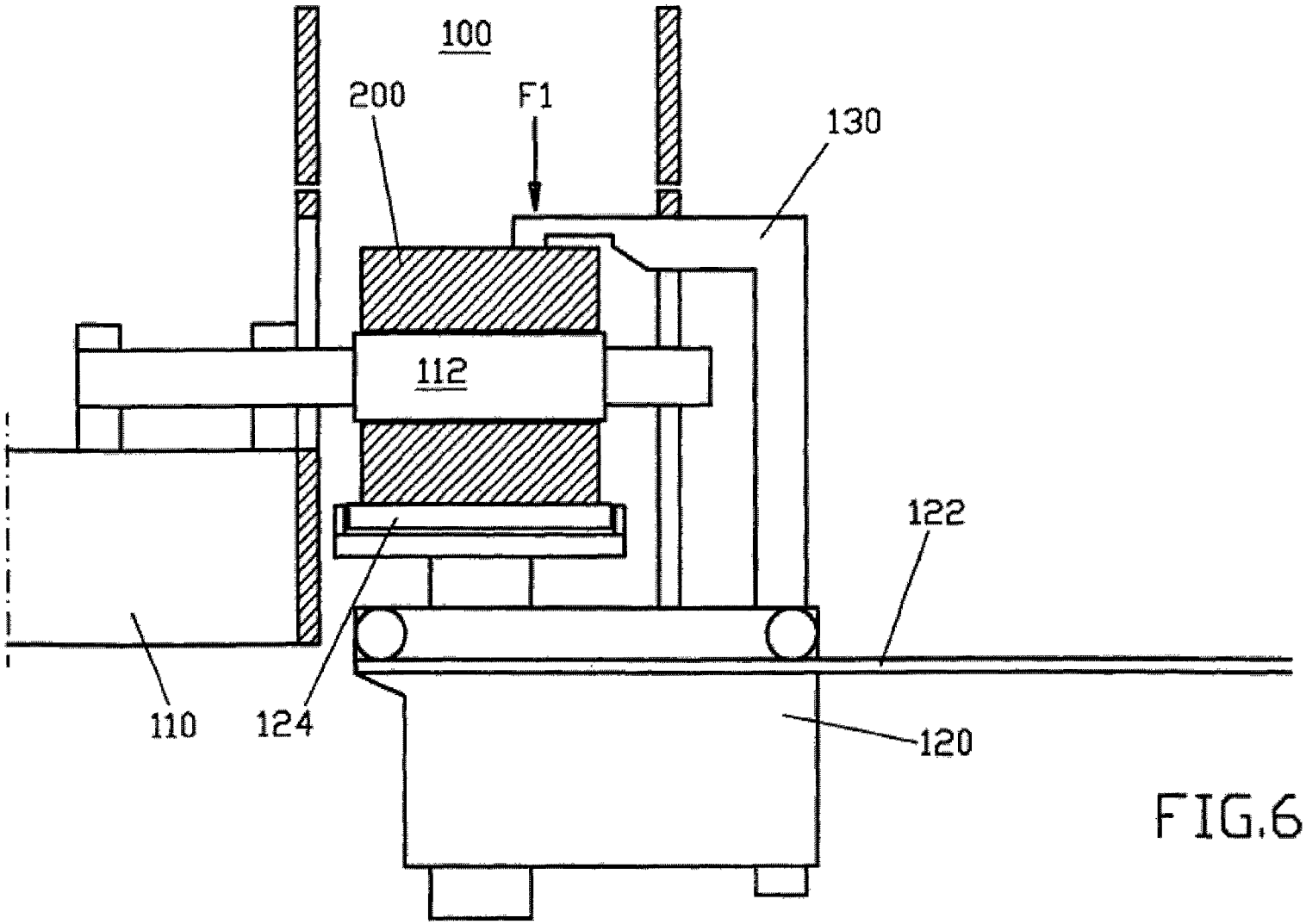
FIG. 6 shows the device according to the invention according to a second embodiment example with a coil within the coiling device.
Figure 7:
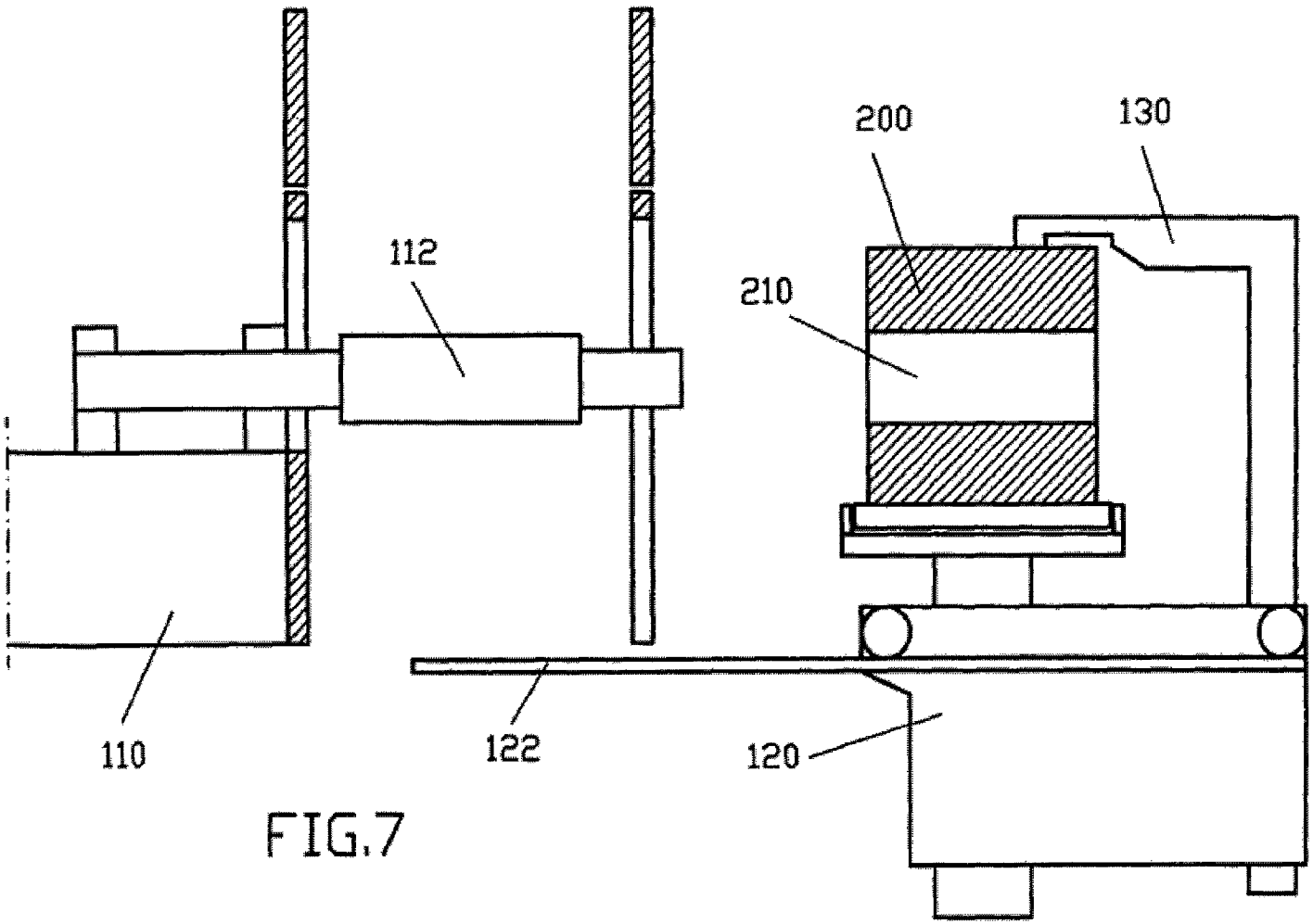
FIG. 7 shows the device according to the invention according to the second embodiment example after the coil has been removed from the coiling device.

FIG. 6 shows a second embodiment example of the present invention, which differs from the first embodiment example described in reference to FIG. 1 only in that the end away from the coil of the first hold-down arm 130 is fixed on the coil stripper car 120. In this arrangement of the first hold-down arm 130, the range of the first hold-down arm 130 is not limited. Instead, even when the coil 200 has been moved on the coil stripper car 120 outside of the coiling device 10, it is ensured that the coil is pressed continuously by means of the first hold-down force F1 on the support 124 of the coil stripper car 120 and is thus prevented from violently uncoiling; see FIG. 7.

Below, the method according to the invention is described in reference to the mentioned figures. It comprises the following steps:

a) Removing the coil 200 from the coiling device 110 on a coil stripper car 120, wherein the coil is applied against two supports 124 of the coil stripper car 120, and at the same time it is pressed by a first hold-down force F1 applied from above onto the outer circumference of the coil 200 against the supports, and is thus secured against violent uncoiling; see FIG. 1;

b) Stopping the coil stripper car 120 before the coil stripper car is beyond the range of the hold-down arm, see FIG. 3;

c) Moving a second coil car 160, with a second hold-down arm 150 arranged thereon, closer to the coil stripper car 120;

d) Moving the second hold-down arm into the coil eye 210 of the transported coil 200, and applying a second hold-down force F2 in the coil eye for pressing the coil onto the support 124 and for securing the coil 200 against violent uncoiling; see FIG. 3;

e) Subsequently removing the first hold-down device 130;

f) Further transport of the coil by means of the coil stripper car 120 to one or more binding position(s) of a coil binding machine for binding the coil with at least one binding to produce a dimensionally stable coil 200, wherein the coil car is preferably shifted synchronously with respect to the coil stripper car 12, in order to maintain the second hold-down force F2 by the second hold-down arm in the coil eye 210 during the further transport; and g) After binding the coil in the coil binding machine: removing the second hold-down device from the coil eye of the transported coil 200.

The step a) comprises moreover:

moving the coil stripper car 120 under the coil 200, when the latter has been placed in the coiling device 110 on a coiling mandrel 112, and secured in the coiling device against violent uncoiling;

raising the support 124 of the coil stripper car 120 from below against the coil 200, so that the coil is applied on the supports 124;

pressing, by means of the first hold-down device 130, for example, in the form of a hold-down arm 130, with the first hold-down force F1, onto the outer circumference of the coil, and thus securing the coil on the two supports against violent uncoiling;

removing/retracting the coiling mandrel 112 from the eye of the coil or alternatively: collapsing or contracting the coiling mandrel 112 in the eye 210 of the coil; and pulling the coil 200 from the coiling mandrel 112, and removing the coil 200 from the coiling device 110 onto the coil stripper car 120.

LIST OF REFERENCE NUMERALS

100 Device for handling a metal strip
110 Coiling device
112 Coiling mandrel
120 Coil stripper car
122 Fixed track configuration
124 Support
130 First hold-down arm
131 Coil-side end of the first hold-down arm
132 End away from the coil of the first hold-down arm
133 Overhang beam
135 Trolley
140 Synchronization device in the form of an electronic control
150 Second hold-down arm
160 Additional coil car
200 Coil
210 Eye of the coil
F1 First hold-down force
F2 Second hold-down force
H Height

The invention claimed is:

1. Device (100) for handling a metal strip, with a coiling device (110) with a coiling mandrel (112) for winding the metal strip to the form of a coil (200) on the coiling mandrel;

and with a coil stripper car (120) with supports (124) for receiving the coil (200) from the coiling mandrel and removing the coil from the coiling device (110);

and a first hold-down arm (130) for applying a first hold-down force (F1) with at least one component in direction of the gravity force to an outer circumference of the core at a mid-plane of the coil for pressing the coil onto the support of the coil stripper car, characterized by a second hold-down arm (150) for applying a second pressure force (F2) with its coil-side end in the eye of the coil (200), wherein the second hold-down arm (150) is designed so that it is set in the eye of the coil (200) in such a manner that the second hold-down force (F2) applied by the second hold-down arm in the eye of the coil has at least one component in the direction of the gravity force.

2. Device (100) according to claim 1, characterized in that that an overhang beam (133) is provided, which is arranged above a path for the coil stripper car, particularly above a fixed track configuration (122), that a trolley (135) is provided for holding the first hold-down arm (130) and for moving together with the hold-down arm (130) on the overhang beam (133); and that a synchronization device is provided for synchronizing the movement of the trolley (135) with the first hold-down arm and of the coil stripper car in such a manner that the first hold-down arm (130), during the movement of the coil stripper car, is applied onto the outer circumference of the coil.

3. Device (100) according to claim 2, characterized in that the synchronization device is designed in the form of an electronic control (140) or in the form of a mechanical coupling of the coil-side end (131) of the hold-down arm to the coil.

4. Device (100) according to claim 2, characterized in that the overhang beam (133) is anchored with one end fixed in or on the area of the coiling device (110).

5. Device (100) according to claim 1, characterized in that the first hold-down arm (130) is coupled mechanically by means of its end away from the coil to the coil stripper car (120).

6. Device (100) according to claim 1, characterized in that the first hold-down arm (130) is designed so it can be moved in and out telescopically.

7. Device (100) according claim 6, characterized in that the second hold-down arm (150) is attached by means of its end away from the coil eye to the coil stripper car (120) or to an additional coil car (160).

8. Device (100) according to claim 1, characterized in that the first and/or second hold-down arms (130, 150) is/are designed so they/it are/is height adjustable.

9. Method for handling a metal strip, with the following steps:

winding the metal strip to form a coil (200) on a coiling mandrel (112) of a coiling device (110);

transferring the coil (200) from the coiling mandrel to a coil stripper car (120);

removing the coil on the coil stripper car from the coiling device;

applying a first hold-down force (F1) with at least one component in direction of the gravity force to the outer circumference of the coil (200) with a first hold-down arm (130) for pressing the coil (200) onto the coil stripper car (120) during the transfer of the coil from the coiling mandrel onto the coil stripper car, and while the coil is being removed from the coiling device (110), characterized by applying a second down force (F2) with at least one component in direction of the gravity force in the eye of the coil using a second hold-down arm for pressing the coil on the supports of the coil stripper car, after the coil on the coil stripper car has been removed at least some distance from the coiling device, and before the end of the range of the first hold-down arm has been reached, and removing the first hold-down arm (130) from the coil (200) after the second hold-down arm (150) engages in the eye of the coil (200).

10. Method according to claim 9, characterized in that, while the coil on the stripper car (120) is being removed from the coiling device (110), at least the coil-side end of the first hold-down arm (130) is also moved synchronously with the coil and the coil stripper car.

11. Method according to claim 9, characterized in that the coil (200) on the coil stripper car (120) is transported further to at least one coil binding machine, which is arranged, for example, outside of the range of the first hold-down arm (130).

12. Method according to claim 9, characterized in that an additional coil car (160), on which the second hold-down arm (150) is anchored by means of its end away from the coil, is moved synchronously with the coil stripper car (120) for the purpose of maintaining the second hold-down force (F2) by the second hold-down arm (150) in the eye of the coil (200) during the further transport.

13. Method according to claim 9, characterized by binding the coil in the coil binding machine and releasing the second hold-down force by removing the second hold-down arm (150) from the eye (210) of the coil (200).

14. Method according to claim 9, characterized in that the first hold-down arm (130) is adjusted in terms of its height so that it can exert the first hold-down force (F1) onto the outer circumference of the coil (200); and/or the second hold-down arm is adjusted in terms of its height so that it can exert the second hold-down force in the eye (210) of the coil (200).

* * * * *